US006838825B2

(12) United States Patent
Shiiki et al.

(10) Patent No.: US 6,838,825 B2
(45) Date of Patent: Jan. 4, 2005

(54) ADJUSTMENT OF LUMINANCE BALANCE OF RED, GREEN AND BLUE LIGHT EMISSIONS FOR PLASMA DISPLAY BY USING DIFFERENT SIZED AREAS OF PHOSPHOR LAYERS PRODUCING CORRESPONDING COLORS

(75) Inventors: Masatoshi Shiiki, Musashimurayama (JP); Choichiro Okazaki, Kodaira (JP); Teruki Suzuki, Funabashi (JP); Keizo Suzuki, Kodaira (JP); Tadashi Furukawa, Chiba (JP); Masaji Ishigaki, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/154,847

(22) Filed: May 28, 2002

(65) Prior Publication Data

US 2002/0140354 A1 Oct. 3, 2002

Related U.S. Application Data

(63) Continuation of application No. 09/290,249, filed on Apr. 13, 1999, now Pat. No. 6,411,032.

(30) Foreign Application Priority Data

Apr. 15, 1998 (JP) ..... 10-104334

(51) Int. Cl.[7] ..... H01J 17/49

(52) U.S. Cl. ..... 313/582; 313/485

(58) Field of Search ..... 313/582–587, 313/484, 485, 610

(56) References Cited

U.S. PATENT DOCUMENTS 5,825,128 A 10/1998 Betsui et al.
6,611,099 B1 * 8/2003 Murata et al. ..... 313/582

OTHER PUBLICATIONS

Japan Display '92, "S16–2 A Full Color AC Plasma Display with 256 Gray Scale", K. Yoshikawa et al, pp. 605–608, no month.

* cited by examiner

*Primary Examiner*—Joseph Williams
(74) *Attorney, Agent, or Firm*—Mattingly, Stanger & Malur, P.C.

(57) ABSTRACT

A plasma display includes a display panel and a driving circuit for driving the display panel. A space for at least one color, of spaces between barrier ribs for defining discharge spaces for red, green and blue colors of the display panel is different from the spaces for other colors.

8 Claims, 6 Drawing Sheets

ADJUSTMENT OF LUMINANCE BALANCE OF RED, GREEN AND BLUE LIGHT EMISSIONS FOR PLASMA DISPLAY BY USING DIFFERENT SIZED AREAS OF PHOSPHOR LAYERS PRODUCING CORRESPONDING COLORS

This is a continuation application of U.S. Ser. No. 09/290,249, filed Apr. 13, 1999 now U.S. Pat. No. 6,411,032, now allowed.

BACKGROUND OF THE INVENTION

The present invention relates to a plasma display which is a flat-type display unit used in receivers for broadcasting, terminals for computers or display for images. $X_3$.

In the plasma display, short-wave ultraviolet rays (having a resonance line of 147 or 172 nm when xenon is used as inert gas) generated in a negative glow area in a small discharge space containing inert gas in a display panel is used as an excitation source to cause phosphor disposed in the discharge space to emit light to thereby make a display in color. A structure of a gas discharge cell of the plasma display as described in, for example, "Japan Display '92", pp 605–608 are depicted in FIGS. 5 and 6.

In the display panel of the plasma display, the resonance line for inert gas having a wavelength smaller than a resonance line of 253.7 nm of mercury vapor is used as an excitation source of the phosphor and a shortwave limitation thereof is a resonance line of 58.4 nm of helium. FIG. 5 schematically illustrates a reflective-type display panel of a general surface-discharge type color plasma display. A front substrate and a rear substrate are integrally combined with each other in fact. The front substrate is mainly composed of a pair of discharge sustaining electrodes formed in parallel to each other on a front glass substrate with a fixed distance therebetween and a dielectric layer formed on the electrodes to perform ac operation. The rear substrate is mainly composed of addressing electrodes formed on a rear glass substrate so that the addressing electrodes are disposed orthogonally to the discharge sustaining electrodes of the front substrate, barrier ribs each having the same structure (space, height and shape of side wall) made of glass having a low melting point and forming a partition between the adjacent addressing electrodes in order to prevent spread of discharge (to define the discharge area), and red (R), green (G) and blue (B) phosphor layers emitting red, green and blue light, respectively, and formed successively into a striped pattern so as to cover surfaces of grooves formed between the barrier ribs. The phosphor layers are formed by applying phosphor paste produced by mixing phosphor particles and vehicle with each other by using the screen printing method or the like after the addressing electrodes and the barrier ribs have been formed on the rear glass substrate and further a volatile component in the layers is removed by means of baking to complete the phosphor layers. The spaces between the barrier ribs, that is, barrier rib pitches defining the discharge spaces are the same for the red, green and blue phosphors as shown in FIG. 6.

The discharge space between the front and rear substrates is filled with discharge gas (mixed gas such as helium, neon and xenon) not shown to effect discharge between the discharge sustaining electrodes including X and Y sustaining electrodes so that the phosphor layers in a unit light emitting area (discharge spot) selected by the addressing electrodes are excited by vacuum ultraviolet rays produced by discharge of gas in the unit light emitting area to thereby attain visible emission. Amounts of light emitting in the unit light emitting area including the red, green and blue phosphor layers corresponding to the three primary colors are combined to make a display in color.

SUMMARY OF THE INVENTION

It is an object of the present invention to provide a plasma display having a structure easy to adjust a halftone color.

It is another object of the present invention to provide a plasma display capable of controlling a color temperature at the time of displaying the white color and displaying a high-quality image.

The luminance of a display panel and particularly a color panel of the plasma display is now being improved annually (lower than 450 cd/m$^2$), although it is lower than that of a color television using a direct-view type cathode-ray tube (CRT) (peak luminance of 600 to 1000 cd/m$^2$) and it desired to improve characteristics such as the luminous efficiency.

Further, the characteristics affecting the image quality include a color temperature at the time of displaying the white color. Particularly, the display for a computer terminal requires the same chromaticity and color temperature as those of paper. In the display using a cathode-ray tube, since the luminance for each of red, green and blue colors can be adjusted easily, the color temperature thereof (reproducible up to 9500 K or more) can be easily adjusted to provide the white color display satisfying the user's request.

On the contrary, in the plasma display, since the luminance for each of red, green and blue colors cannot be adjusted independently, the color temperature for the white color display which is a representative of the halftone color cannot be adjusted to any value. Accordingly, it is strongly desired to develop the method of capable of adjusting the luminance for each of red, green and blue colors in the plasma display to any value.

In addition, the plasma display has a problem that discharge starting voltages by the red, green and blue phosphor films or layers are different and that is one cause to make it difficult to adjust the color temperature. Accordingly, it is strongly desired to develop the method of capable of reducing a difference in the discharge starting voltages by the red, green and blue phosphor layers in the plasma display.

Particularly, in the plasma display used in a computer terminal, the impossibility of adjusting the color temperature is a large problem.

The present invention realizes a plasma display having a structure easy to adjust the color temperature of the halftone color.

The above objects can be achieved by differentiating a space for at least one color, of spaces between barrier ribs for defining discharge spaces for red, green and blue colors of the display panel from the spaces for other colors.

The color temperature at the time of displaying the white color in a luminous display such as a plasma display is determined by the balance of the color temperatures of red, green and blue light emission constituting color components and the luminance thereof when phosphor materials for effecting red, green and blue light emission are the same. For example, when the color temperature of the white color is at a point of 6000 K on the locus of white color, the luminance of blue light emission can be made higher to thereby obtain the white color point having a higher color temperature. Further, the luminance can be made higher by reducing a discharge starting voltage, so that the substantially same effects can be attained. In addition, generally, the luminance can be made higher to thereby improve the display quality of halftone color.

Accordingly, in the plasma display of the present invention, the spaces between barrier ribs, which have the same size in the prior art, are varied in accordance with the light emission performance of red, green and blue phosphors to constitute the rear substrate.

Since adjustment of the color temperature of white color is made by adjusting the luminance balance of red, green and blue light emissions, the space between the barrier ribs corresponding to the position filled or applied with phosphor constituting a color component requiring a higher luminance is made wider than the spaces for other colors, so that an area of the phosphor layer producing the corresponding luminous color can be increased and the higher luminance can be obtained (FIG. 1). Further, the space between the barrier ribs at the position filled or applied with phosphor constituting a color component having too high a luminance for the luminance balance is made narrower than the spaces for other colors, so that an area of the phosphor layer producing the corresponding luminous color can be reduced and the luminance can be reduced (FIG. 2). Various combination of spaces between the barrier ribs constituting the red, green and blue phosphor layers can be made. There are various cases where only the space between the barrier ribs for the red phosphor layer is made larger or smaller, where only the space for the green phosphor layer is made larger or smaller, where only the space for the blue phosphor layer is made larger or smaller, where the respective spaces for the red, green and blue phosphor layers are different from one another (FIG. 3) or the like. In addition, the spaces for the barrier ribs can be set to various values allowed in the design of the display panel of the plasma display in accordance with the degree of widening or narrowing the spaces. For example, a difference between the spaces for two colors of the red, green and blue colors can be made 5%, 20% or 50% larger than a narrower space thereof. On the other hand, since the upper limit thereof is determined by the minimum space realizable in the display panel when the size of one pixel is constant, the upper limit can be set to an infinite value, while actually the minimum space is restricted depending on the degree of progress in the process technique, the strength of material, the discharge system and the like. It is no meaning that the upper limit is specified.

Further, since the discharge starting voltage can be reduced by widening the space between the barrier ribs, even the phosphor requiring a high voltage in order to obtain sufficient luminance can obtain the higher luminance by a lower voltage by widening the space.

According to the present invention, there can realize the plasma display capable of controlling the color temperature at the time of displaying the white color and displaying the high-quality picture.

DESCRIPTION OF THE EMBODIMENTS

The present invention is now described with reference to embodiments.

Embodiment 1

Figure 1:
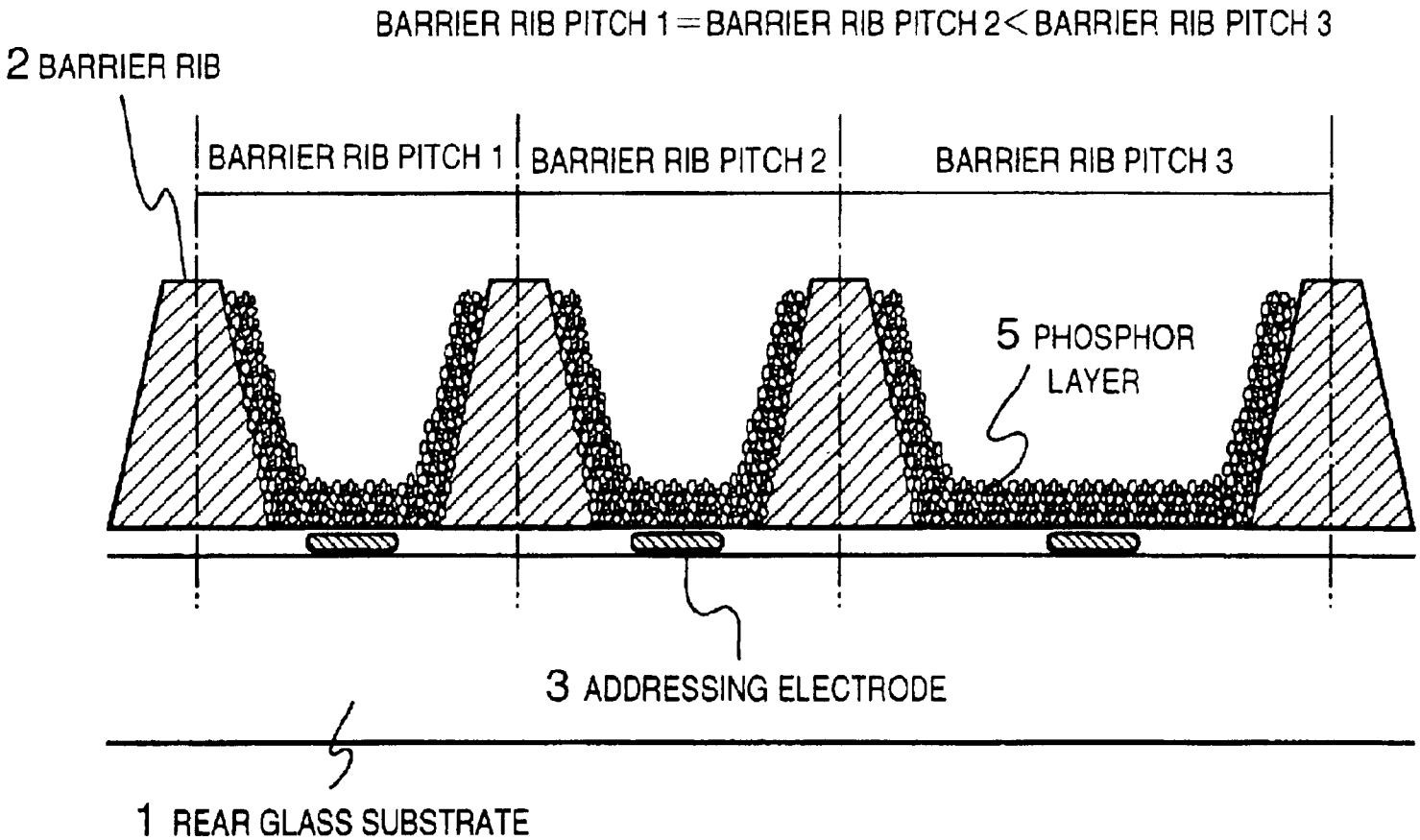
FIG. 1 is a cross-sectional view of a rear substrate of a display panel used in a plasma display according to an embodiment of the present invention in which space between barrier ribs for a luminous cell of one color is made larger than that of luminous cells for other colors.
Figure 2:
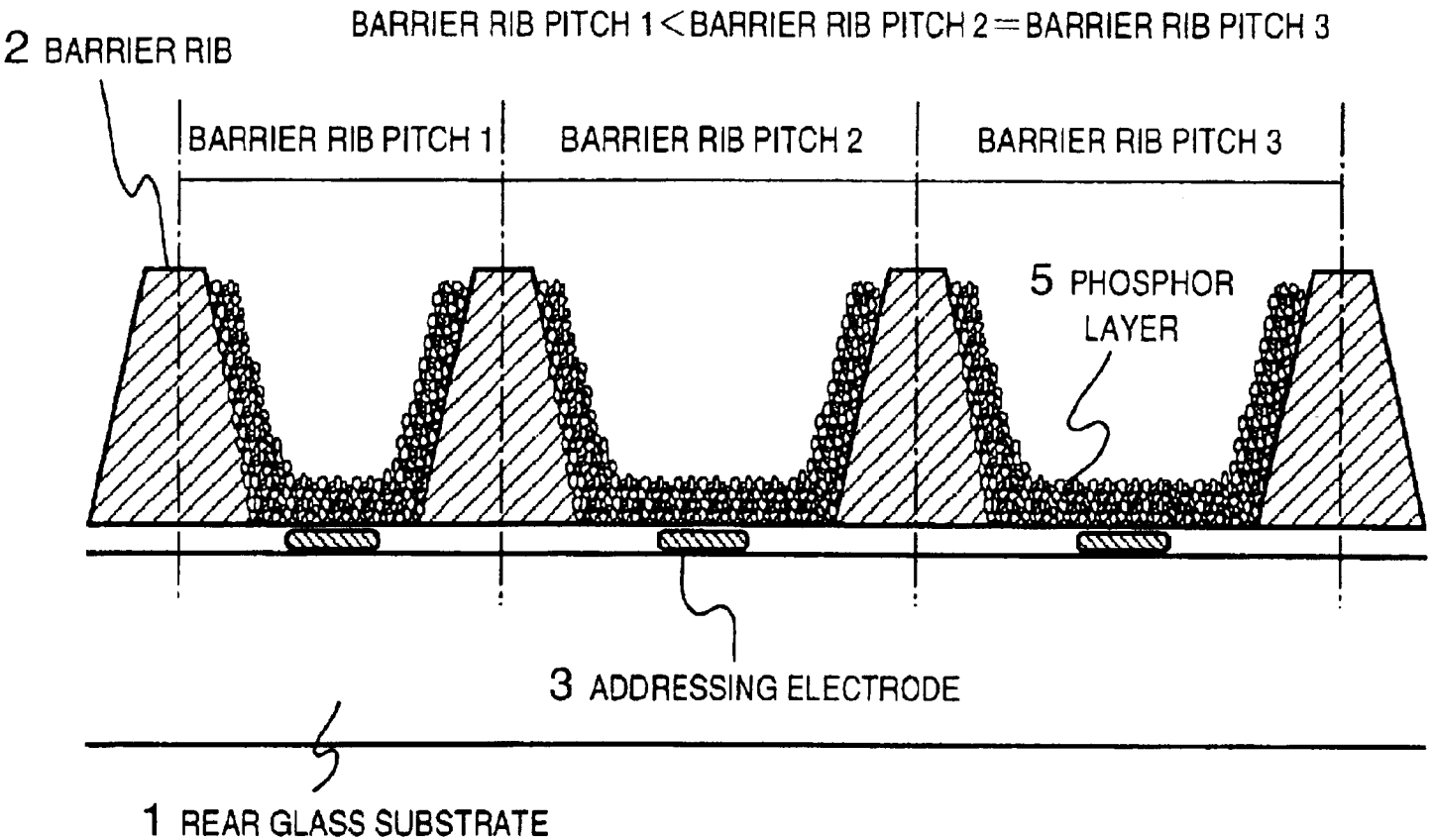
FIG. 2 is a cross-sectional view of a rear substrate of a display panel used in a plasma display according to an embodiment of the present invention in which space between barrier ribs for a luminous cell of one color is made narrower than that of luminous cells of other colors.
Figure 3:
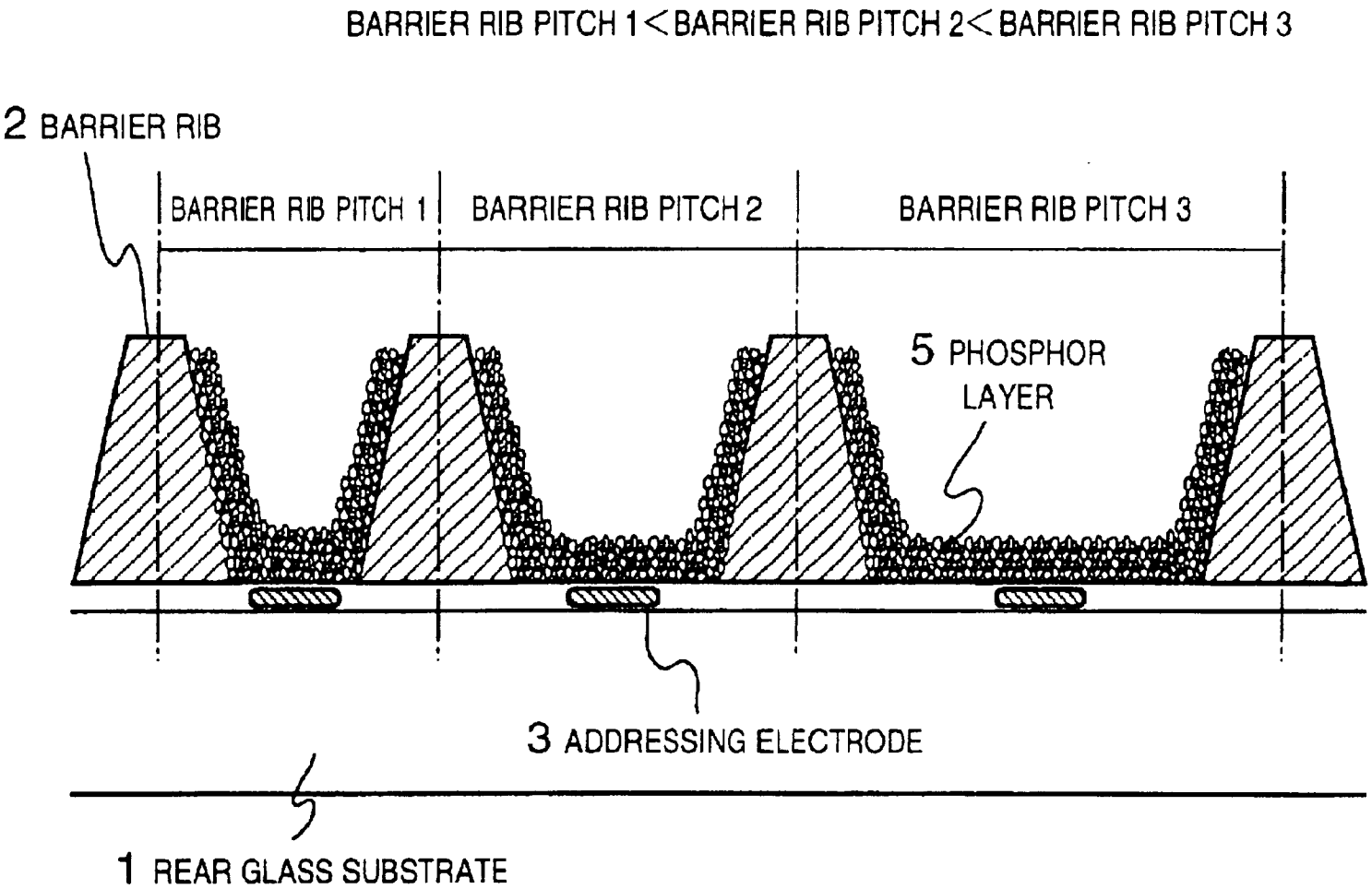
FIG. 3 is a cross-sectional view of a rear substrate of a display panel used in a plasma display according to an embodiment of the present invention in which spaces between barrier ribs for luminous cells of respective colors are made different from one another.

Referring now to FIG. 1, a cross section of barrier ribs for one pixel formed on a rear glass substrate 1 of a display panel is shown. The barrier ribs 2 are fabricated as follows. Addressing electrodes 3 and dielectric layers 4 are first formed on the rear glass substrate. Then, material for the barrier ribs is printed thereon to form a thick layer and a blasting mask is formed on the material. The blasting mask is removed to thereby form the barrier ribs 2. Spaces between the barrier ribs are adjusted in accordance with kinds (red, green and blue) of phosphors to be filled or applied. In this example, in order to increase the luminance for blue color, the space between the barrier ribs of the luminous cell for blue color is larger than that of the luminous cells for red and green colors. Phosphor layers are formed in grooves corresponding to red, green and blue phosphors in order in a striped pattern so that the phosphor layers cover surfaces of the grooves between the barrier ribs. In fabrication of the phosphor layers, phosphor particles of 40 weight percents and vehicle of 60 weight percents are mixed to form phosphor paste and the phosphor paste is applied on the groove surfaces by means of the screen printing. Then, evaporation of a volatile component in the paste and burning of organic matters in the paste are made to remove them by means of drying and baking processes, so that the phosphor layers are formed. The phosphor layers 5 of the present invention are constituted by phosphor particles having a center diameter equal to or smaller than 10 $\mu$m and have bottoms having a thickness of 20 $\mu$m and side walls having a thickness of 15 $\mu$m at a center thereof. The red phosphor is constituted by $(Y, Gd)BO_3$, :Eu, the green phosphor by $Zn_2SiO_4$:Mn, and the blue phosphor by $BaMgAl_{10}O_{17}$:Eu.

In the embodiment, the space between the barrier ribs for the red luminous cell is made about 5% larger than that of the red and green luminous cells. The display panel used in the embodiment has the size of 25-inch type and the number of pixels corresponding to XGA (1024×768) and each pixel has the size of 495 $\mu$m×495 $\mu$m. The space for the red and green luminous cells is 162 $\mu$m and the space for the blue luminous cell is 171 $\mu$m (the whole size of one pixel is 495 $\mu$m).

The rear substrate as structured above is integrally combined with the front substrate and discharge gas is filled therebetween to thereby fabricate the display panel.

Embodiment 2

In this embodiment, the space between the barrier ribs for the blue luminous cell was made about 10% larger than that of the red and green luminous cells and the display panel was fabricated in accordance with the same procedure as the embodiment 1. Other conditions were the same as the embodiment 1. The space between the barrier ribs for the red and green luminous cells was 160 μm and that of the blue luminous cell was 175 μm (the whole size of one pixel is 495 μm).

Embodiment 3

In this embodiment, the space between the barrier ribs for the blue luminous cell was made about 20% larger than that of the red and green luminous cells and the display panel was fabricated in accordance with the same procedure as the embodiment 1. Other conditions were the same as the embodiment 1. The space between the barrier ribs for the red and green luminous cells was 155 μm and that of the blue luminous cell was 185 μm (the whole size of one pixel is 495 μm).

Embodiment 4

In this embodiment, the space between the barrier ribs for the blue luminous cell was made about 50% larger than that of the red and green luminous cells and the display panel was fabricated in accordance with the same procedure as the embodiment 1. Other conditions were the same as the embodiment 1. The space between the barrier ribs for the red and green luminous cells was 140 μm and that of the blue luminous cell was 215 μm (the whole size of one pixel is 495 μm).

Embodiment 5

In this embodiment, the space between the barrier ribs for the blue luminous cell was made about 110% larger than that of the red and green luminous cells and the display panel was fabricated in accordance with the same procedure as the embodiment 1. Other conditions were the same as the embodiment 1. The space between the barrier ribs for the red and green luminous cells was 120 μm and that of the blue luminous cell was 255 μm (the whole size of one pixel is 495 μm).

COMPARISON EXAMPLE 1

Figure 5:
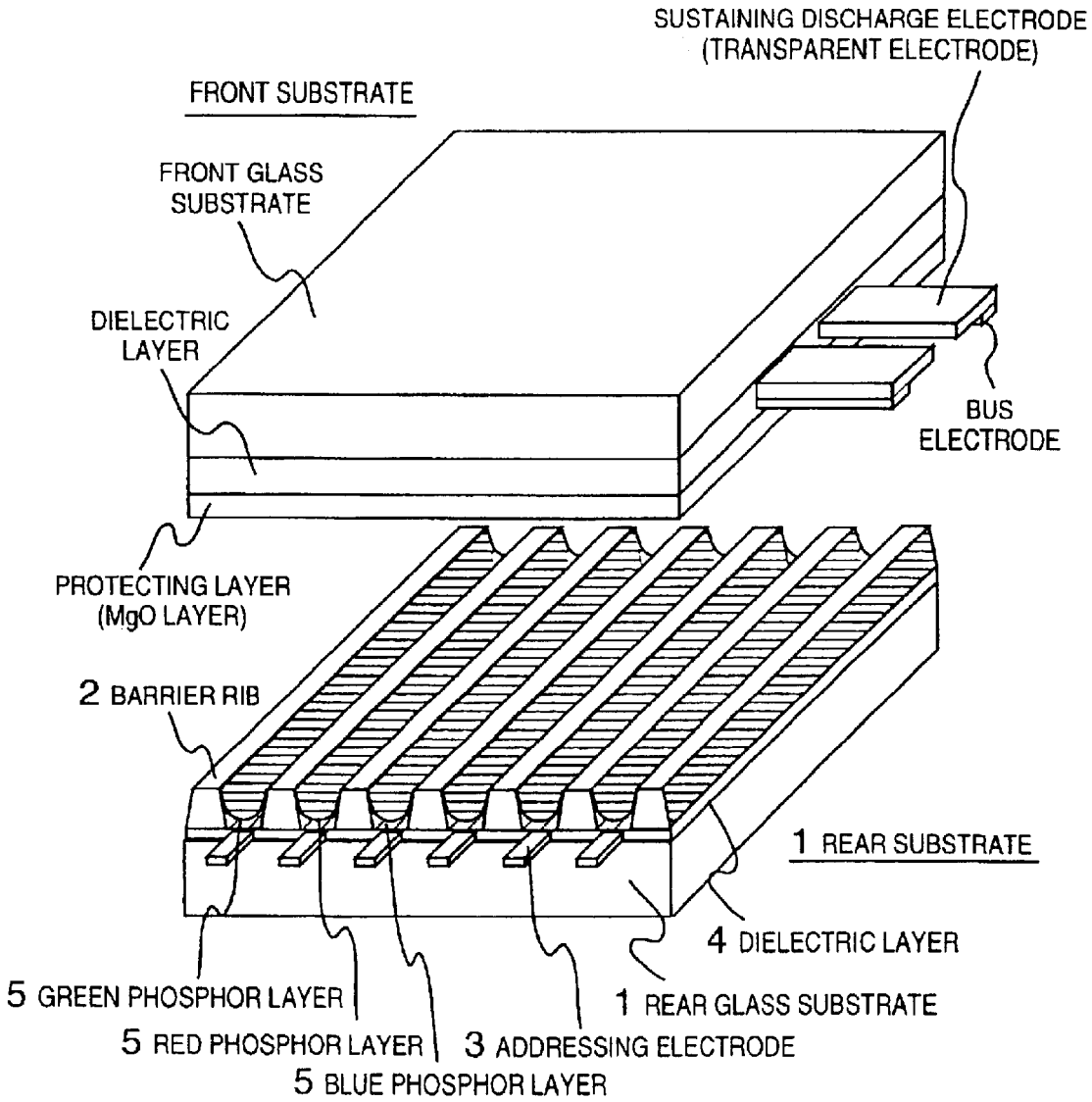
FIG. 5 is a schematic diagram illustrating a conventional display panel in which spaces between barrier ribs of luminous cells of respective colors are equal to one another.
Figure 6:
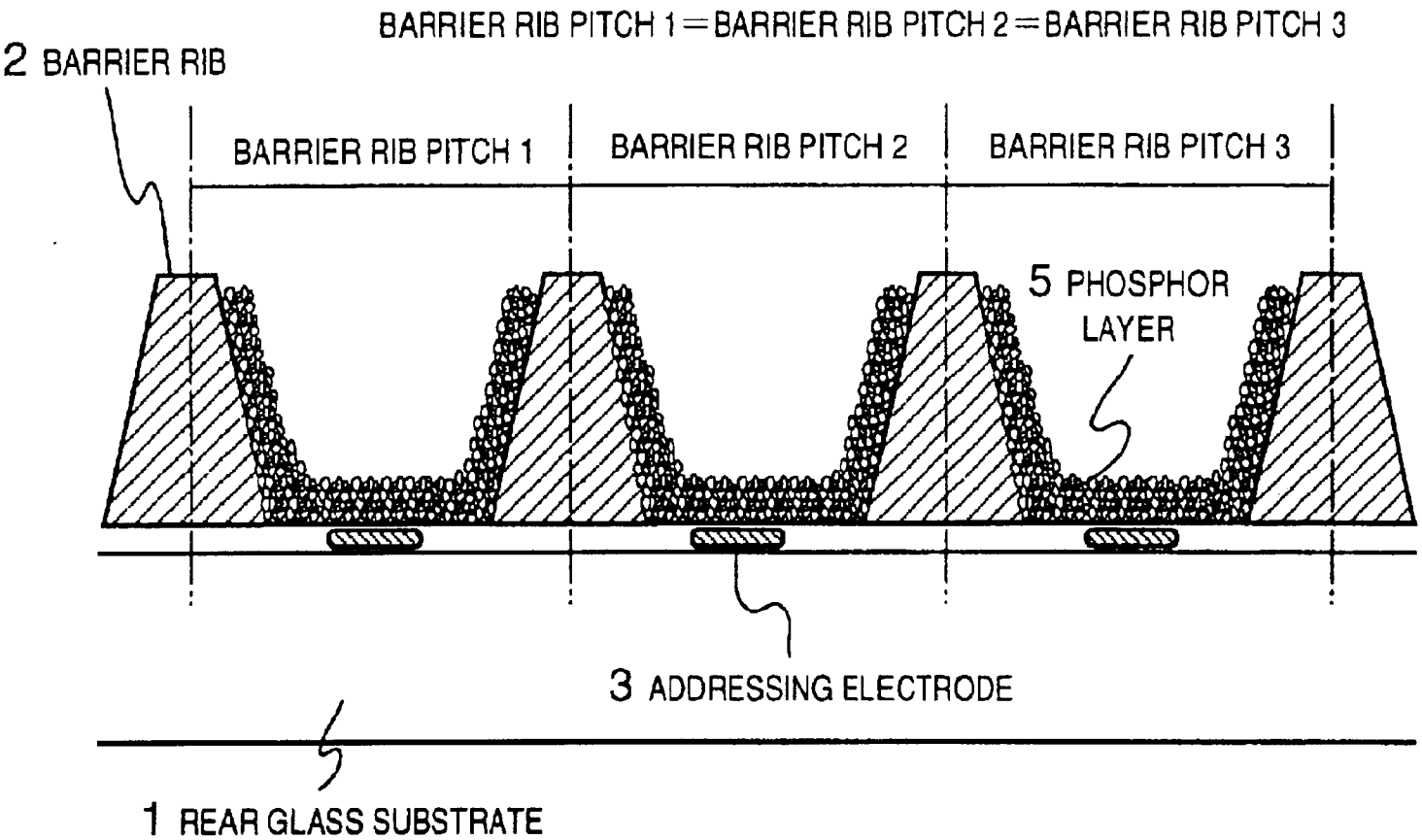
FIG. 6 is a cross-sectional view of a rear substrate of a display panel used in a conventional plasma display in which spaces between barrier ribs of luminous cells of respective colors are equal to one another.

As a display panel for comparison with the display panels fabricated in the embodiments 1 to 5, the rear substrates (FIGS. 5 and 6) having the spaces between the barrier ribs which were all constant (165 μm) irrespective of the kind (red, green and blue) of phosphor to be used were used to fabricate the display panel for the comparison example 1 in accordance with the same procedure as the embodiment 1.

The display panel for the comparison example 1 was used as a reference and the luminance characteristic of the display panels of the embodiments 1 to 5 were evaluated.

The luminance for white color display was slightly scattered in each of the display panels, while there was a tendency that the luminance for white color was reduced by widening the space between the barrier ribs for the blue phosphor layer as compared with that of the red and green phosphor layers. However, it has been confirmed that the color temperature for white color can be controlled to be shifted to a white color point having a higher color temperature certainly by widening the space between the barrier ribs for the blue phosphor layer.

The white color point of the display panel for the comparison example 1 was about 6000 K, whereas the white color points of the display panels were larger than 6100 K in the embodiment 1, 6500 K in the embodiment 2, 7500 K in the embodiment 3, 9000 K in the embodiment 4 and 9500 K in the embodiment 5.

As described above, it could be confirmed that the spaces between the barrier ribs can be made different to thereby adjust the color temperature for white color without large reduction of luminance and without need of complicated processes or without modification of any external driving circuit.

Embodiment 6

In the plasma display, a fixed voltage is applied to the phosphor layers to thereby drive the display panel. Accordingly, when the response characteristic to the drive voltage is different depending on phosphor material, it is not easy to correct the response characteristic. Hence, it is not possible to adjust the color temperature for white color easily as in the cathode-ray tube. Accordingly, in the embodiment, it is confirmed that the space between the barrier ribs is varied to thereby control a discharge starting voltage instead of adjustment of luminance so that the color temperature can be adjusted.

In the embodiment, the display panel having the space between the barrier ribs for the green luminous cell which is made larger than that of the red and blue luminous cell was fabricated in accordance with the same procedure as the embodiment 1 and the tendency of the discharge starting voltage was examined. The green phosphor constituted by $Zn_2SiO_4$:Mn, the red phosphor by (Y, Gd)$BO_3$, :Eu, and the blue phosphor by $BaMgAl_{10}O_{17}$:Eu were used. The display panel has the size of 25-inch type and the number of pixels corresponding to XGA (1024×768) and each pixel has the size of 495 μm×495 μm.

Further, the space between the barrier ribs for the green luminous cell was made about 5% larger than that of the red and blue luminous cells. The space between the barrier ribs for the red and blue luminous cells was formed to be 162 μm and that of the green luminous cell was formed to be 171 μm (the whole size of one pixel was 495 μm).

The rear substrate thus structured was integrally combined with the front substrate in accordance with the same procedure as in the prior art and discharge gas was filled therebetween to fabricate the display panel.

Embodiment 7

In this embodiment, the space between the barrier ribs for the green luminous cell was made about 10% larger than that of the red and blue luminous cells and the display panel was fabricated in accordance with the same procedure as the embodiment 1. Other conditions were the same as the embodiment 6. The space between the barrier ribs for the red and blue luminous cells was 160 μm and that of the green luminous cell was 175 μm (the whole size of one pixel was 495 μm).

Embodiment 8

In this embodiment, the space between the barrier ribs for the green luminous cell was made about 20% larger than that of the red and blue luminous cells and the display panel was fabricated in accordance with the same procedure as the embodiment 1. Other conditions were the same as the embodiment 6. The space between the barrier ribs for the red and blue luminous cells was 155 μm and that of the green luminous cell is 185 μm (the whole size of one pixel is 495 μm).

Embodiment 9

In this embodiment, the space between the barrier ribs for the green luminous cell was made about 50% larger than that of the red and blue luminous cells and the display panel was fabricated in accordance with the same procedure as the embodiment 1. Other conditions were the same as the embodiment 6. The space between the barrier ribs for the red and blue luminous cells was 140 μm and that of the green luminous cell was 215 μm (the whole size of one pixel was 495 μm).

Embodiment 10

In this embodiment, the space between the barrier ribs for the green luminous cell was made about 110% larger than that of the red and blue luminous cells and the display panel was fabricated in accordance with the same procedure as the embodiment 1. Other conditions were the same as the embodiment 1. The space between the barrier ribs for the red and blue luminous cells is 120 μm and that of the green luminous cell is 255 μm (the whole size of one pixel is 495 μm).

Next, the characteristics of the display panels fabricated in the embodiments 6 to 10 were compared with those of the display panel for comparison example 1. The luminance for the white color display was slightly scattered in each of the display panels. However, it could be confirmed that the color temperature of the white color can move toward the color temperature of the green phosphor certainly by widening the space between the barrier ribs for the green phosphor layer. Further, it could be confirmed that a value of an address voltage becomes lower than the discharge starting voltage for the comparison example 1 by widening the space between the barrier ribs of the green phosphor layer. Accordingly, it is understood that movement of the color temperature can attain indirect increase of luminance by the reduced discharge starting voltage brought by the increased area of the green phosphor layer in addition to direct increase of the luminance by the increased area of the green phosphor layer.

As the result, it could be confirmed that the balance of luminance can be controlled directly to adjust the color temperature of the white color by differentiating the spaces between the barrier ribs without need of complicated processes or without modification of any external driving circuit and in addition the color temperature of the white color can be also adjusted by controlling the discharge starting voltage.

Embodiment 11

Figure 4:
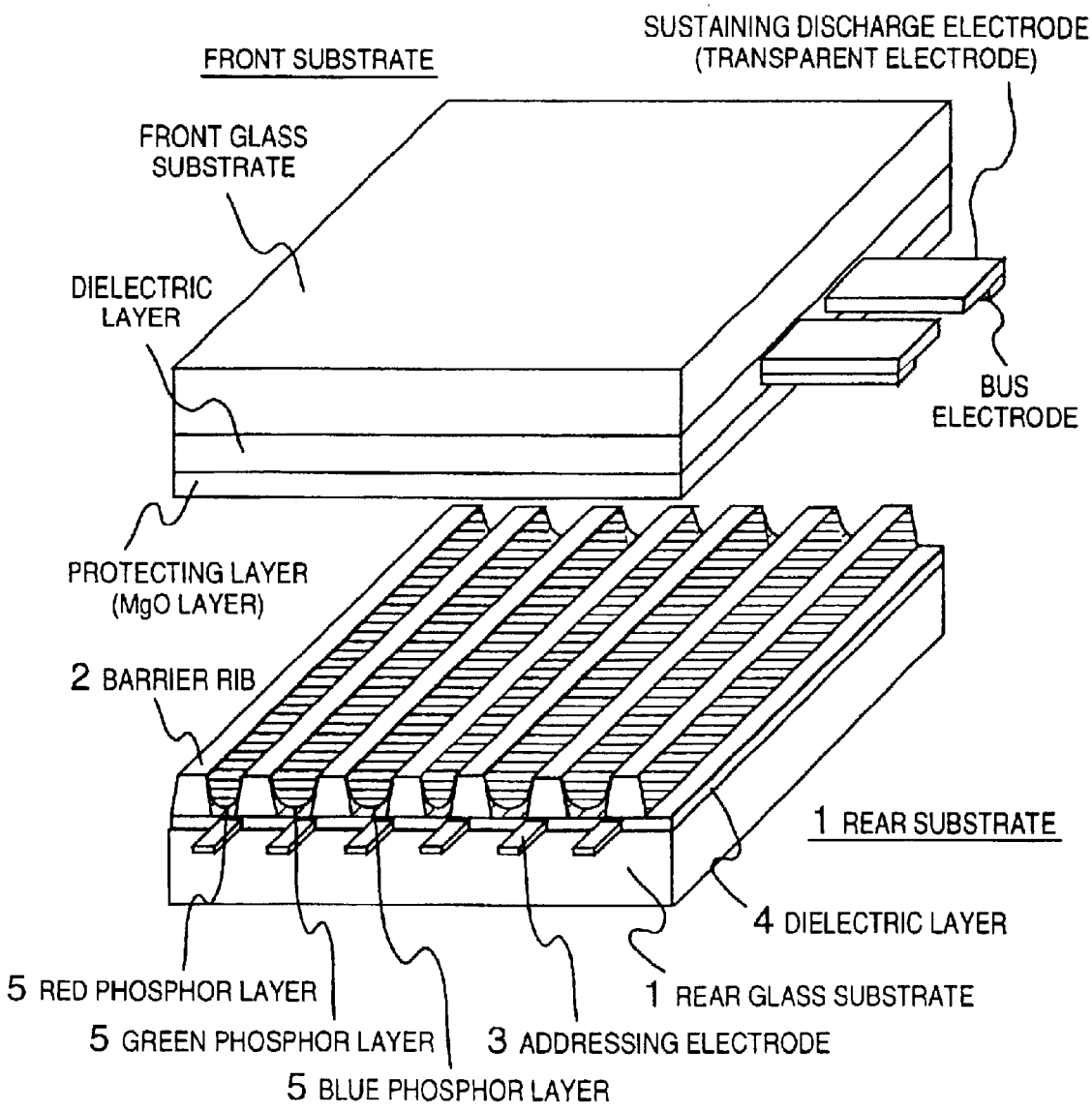
FIG. 4 is a schematic diagram illustrating a display panel used in a plasma display according to an embodiment 11 of the present invention in which space between barrier ribs for a luminous cell of a red color is made narrower than that of luminous cells of other colors.

In this embodiment, a display panel (FIG. 4) in which the space between the barrier ribs for the red luminous cells was made smaller than that of the green and blue luminous cells was fabricated in accordance with the same procedure as the embodiment 1 and a signal processing circuit system and the like were incorporated into the display panel to be used as a display for a computer terminal. The performance thereof was evaluated as a plasma display of a computer for displaying a color static picture and a text.

The display panel had the size of the 25-inch type and the number of pixels corresponding to XGA (1024×768) and each pixel had the size of 495 μm×495 μm The space between the barrier ribs for the red luminous cell was 135 μm and that of the green and blue luminous cells was 180 μm (the whole size of one pixel was 495 μm).

The picture on this plasma display has the color temperature of the white color set in as deep a position as about 9300 K and in addition the satisfactory reproducibility of color as compared with the plasma display using the display panel (FIGS. 5 and 6) of the comparison example 1. Consequently, the plasma display of the embodiment 11 has the substantially same display quality for the color static picture as the cathode-ray tube. Furthermore, the white color display like paper could be obtained even at the time of displaying a text and characters could be displayed clearly.

As described above, it has been understood that the plasma display of the embodiment has the display quality improved by controlling the color temperature of the white color by means of the spaces between the barrier ribs. Further, the discharge starting voltage was substantially uniformed and a load on a circuit was reduced.

Embodiment 12

In this embodiment, the display panel of the embodiment 2 was used to assemble a set for receiving a television broadcast and the performance as the plasma display was evaluated. The resolution upon display of television was NTSC.

A television displaying circuit system including a display panel driving circuit, a television tuner, a loud-speaker and the like were incorporated into the plasma display of the embodiment 12.

The picture on the plasma display of the embodiment had fine and clear white color display as compared with the conventional plasma display and improved color reproducibility as a whole.

As described above, it has been understood that the plasma display of the embodiment had the display quality improved by controlling the color temperature of the white color by means of the spaces between barrier ribs.

The present invention is not limited to combination of the phosphor layers and the spaces between the barrier ribs as described in the above embodiment and can be applied to combination of various phosphor materials and the spaces between the barrier ribs.

What is claimed is:

1. A plasma display comprising a display panel with red, green and blue emission phosphors, a driving circuit for driving said display panel, and a display circuit for displaying television, wherein a space and light emitting area for at least one color, of spaces and light emitting areas between straight barrier ribs for defining discharge spaces for red, green and blue colors of said display panel is different from said spaces and light emitting areas for other colors.

2. A plasma display according to claim 1, wherein a difference between said spaces and light emitting areas for two colors of said red, green and blue colors is equal to or larger than 5% as compared with a narrower space and light emitting area of the spaces and light emitting areas for said two colors.

3. A plasma display according to claim 1, wherein a difference between said spaces and light emitting areas for two colors of said red, green and blue colors is equal to or larger than 20% as compared with a narrower space and light emitting area of the spaces and light emitting areas for said two colors.

4. A plasma display according to claim 1 wherein a difference between said spaces and light emitting areas for two colors of said red, green and blue colors is equal to or larger than 50% as compared with a narrower space and light emitting area of the spaces and light emitting areas for said two colors.

5. A plasma display according to claim 1, wherein said space and light emitting area for color of red is different from said spaces and light emitting areas for the other two colors.

6. A plasma display according to claim 1, wherein said space and light emitting area for color of green is different from said spaces and light emitting areas for the other two colors.

7. A plasma display according to claim 1, wherein said space and light emitting area for a color of blue is different from said spaces and light emitting areas for the other two colors.

8. A plasma display according to claim 1, wherein said spaces and light emitting areas for colors of red, green and blue differ mutually.

* * * * *